US005379624A

United States Patent [19]

Harman et al.

[11] Patent Number: 5,379,624

[45] Date of Patent: Jan. 10, 1995

[54] SLAVED TUBE LENGTH CONTROL FOR HAIRPIN BENDER

[75] Inventors: Galen B. Harman, La Grange, Ind.; James G. Milliman, Sturgis, Mich.

[73] Assignee: Burr Oak Tool & Gauge Company, Sturgis, Mich.

[21] Appl. No.: 156,274

[22] Filed: Nov. 22, 1993

[51] Int. Cl.[6] ..... B21D 7/04

[52] U.S. Cl. ..... 72/149; 72/150; 72/21

[58] Field of Search ..... 72/149, 150, 158, 21

[56] References Cited

U.S. PATENT DOCUMENTS

| | | | |
|---|---|---|---|
| 3,553,989 | 1/1971 | Munro et al. | 72/149 |
| 4,313,324 | 2/1982 | Pearson | 72/149 |
| 4,683,649 | 8/1987 | Sbalchiero et al. | 29/726 |
| 4,831,856 | 5/1989 | Gano et al. | 72/149 |
| 5,233,853 | 8/1993 | Milliman | 72/24 |
| 5,259,224 | 11/1993 | Schwarze | 72/149 |

*Primary Examiner*—David Jones

*Attorney, Agent, or Firm*—Flynn, Thiel, Boutell & Tanis

[57] ABSTRACT

A method and apparatus for controlling the orienting of the ends of a finite length segment of tube following a bend thereof through a predefined angle. A supplying and delivering device supplies at least one straight finite length segment of tube to a tube bender for bending the tube about a bend axis. A first end of the finite length segment is oriented a predetermined distance from a bend axis about which the finite length segment is to be bent. The finite length segment is clamped to the bend arbor for movement therewith. The bend arbor is moved through the predefined angle to effect a bending of the finite length segment while simultaneously pushing the first end of said finite length segment toward a location whereat the finite length segment is clamped to the bend arbor. A rate of movement and distance through which the first end is moved is controlled to a ratio of the distance to be moved divided by the number of degrees in the predefined angle, the predetermined distance equalling the ratio multiplied by the number of degrees in said predefined angle.

13 Claims, 5 Drawing Sheets

SLAVED TUBE LENGTH CONTROL FOR HAIRPIN BENDER

FIELD OF THE INVENTION

This invention relates to a tube length control method and apparatus for a tube bending mechanism and, more particularly, is an improvement to the tube bending structure illustrated in U.S. Pat. No. 5,233,853.

BACKGROUND OF THE INVENTION

U.S. Pat. No. 5,233,853 discloses a device for simultaneously stretch straightening a plurality of side by side oriented segments of tubing for use in manufacturing heat exchangers and bending that tubing to form hairpin tubes. In the process of manufacturing a plurality of hairpin tubes simultaneously, difficulty was being encountered in keeping the legs of the "U" of the hairpin tubes to the same length. Varying frictional forces were occurring as each tube was being bent so that following a bending of a plurality of tubes, the length of the respective legs would be substantially different. During a lacing of the hairpin tubes into a stack of heat exchanger fins, the assembled hairpin tubes and heat exchanger fins would be presented to a work station whereat conventional return bends would be soldered to the open ends of the hairpins tubes to form a fluid circuit for the heat exchanger fluid (see U.S. Pat. No. 4,683,649). Automated soldering equipment require that the joint that is to be soldered be accurately presented to the robotics so that soldering can occur at a precise location. If the free open ends of the hairpin tubes are at differing heights, the return bends will not be properly located for other state of the art assembly operations. If a return bend is to be soldered in place, and the open ends are at differing heights, the return bends will not be properly soldered by the robotics by reason of the fact that the joint that is to be soldered is not present at the desired location.

Therefore, equipment which will accurately manufacture hairpin tubes wherein the lengths of the legs of the hairpin tubes are precisely controlled will be beneficial in the manufacture of heat exchanger coils.

Accordingly, it is an object of the invention to provide a tube bender method and apparatus which will accurately control the length of the legs of the U-shaped hairpin tube to a prescribed length.

It is a further object of the invention to provide a hairpin bender which will enable the bending of a plurality of such hairpin tubes simultaneously, each of the plurality of hairpin tubes having legs of a precisely controlled length.

It is a further object of the invention to provide the invention as an improvement to the tube bending structure illustrated in U.S. Pat. No. 5,233,853.

SUMMARY OF THE INVENTION

In general, the objects and purposes of the invention are met by providing a tube length control method and apparatus for a tube bending mechanism which includes a tube bending device and a supply and delivery mechanism for intermittently supplying at least one finite length segment of tubing and delivering the finite length segment of tubing to the tube bending device. The tube bending device includes a bend arbor pivotal about a bend axis and an elongated tube mandrel extending longitudinally away from the bend arbor on a side of the bend axis remote from the supply and delivery mechanism. The supply and delivery mechanism simultaneously causes a first end of the finite length segment of tube to become telescoped over the tube mandrel as the finite length segment is delivered to the tube bending device. A clamping mechanism is provided adjacent the bend arbor and is initially oriented on a side of the bend axis adjacent the supply and delivery mechanism. The clamping mechanism effects a clamping of the finite length segment to the bend arbor to thereby fixedly orient a second end of the finite length segment from the bend axis. A drive device is provided for drivingly pivoting the bend arbor through a predetermined angle to effect a bending of the finite length segment. A first control mechanism is provided for controlling the delivery of the finite length segment to the tube bender so that the first end thereof is oriented a predetermined distance on a side of a plane, oriented perpendicular to a longitudinal axis of the finite length segment and containing the bend axis, that is remote from the supply and delivery mechanism. A second drive device is provided for drivingly engaging the first end of the finite length segment and for pushing the first end toward the clamping mechanism as bending occurs. A second control device is provided for controlling a rate of movement and a distance through which the first end is moved along the tube mandrel to a ratio of $\pi R$ divided by the number of degrees in the predetermined angle, where R is a radius through which the longitudinal axis of the finite length segment is bent following a movement of the bend arbor through the predetermined angle. The predetermined distance equals the aforesaid ratio multiplied by the number of degrees in the predefined angle.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DISCUSSION

Figure 1:
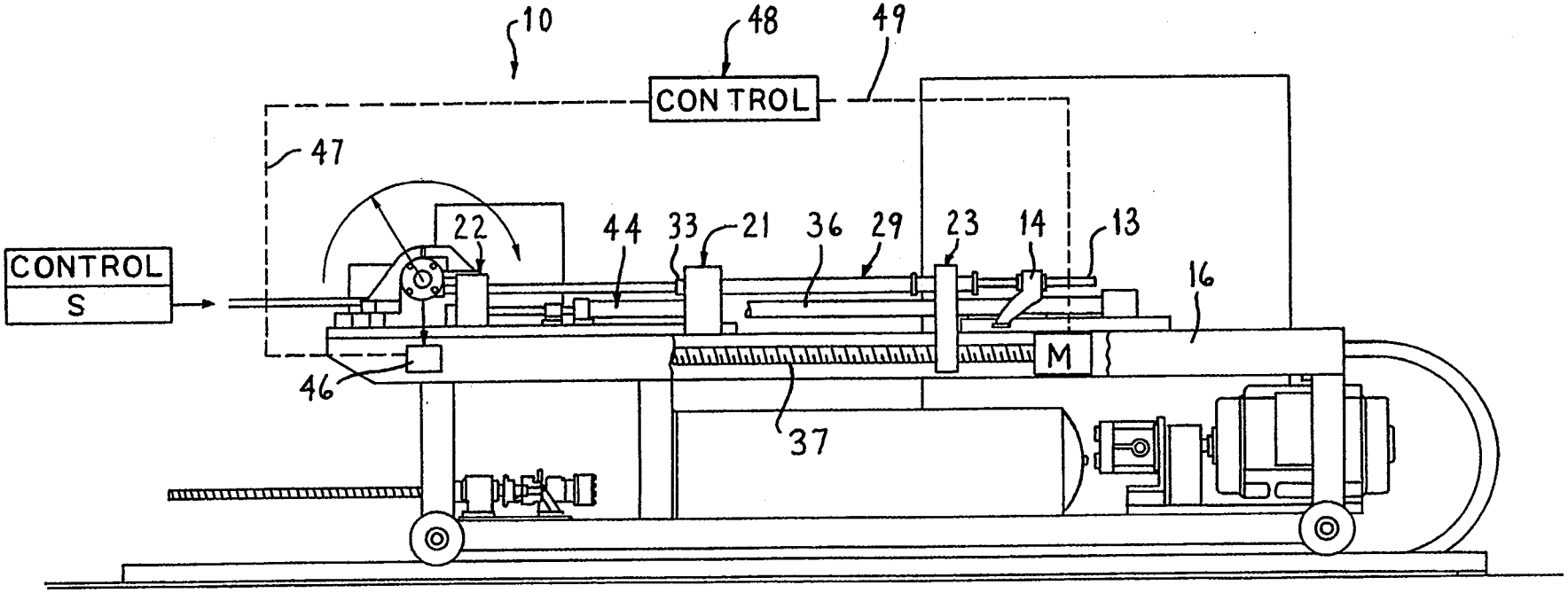
FIG. 1 is a side view of a tube bender embodying the invention.

Certain terminology will be used in the following description for convenience and reference only and will not be limiting The words "upwardly", "downwardly", "rightwardly" and "leftwardly" will designate directions in the drawings to which reference is made. The words "inwardly" and "outwardly" will refer to directions toward and away from, respectively, the geometric center of the device and designated parts thereof. Such terminology will include the words above specifically mentioned, derivatives thereof and words of similar import.

Figure 2:
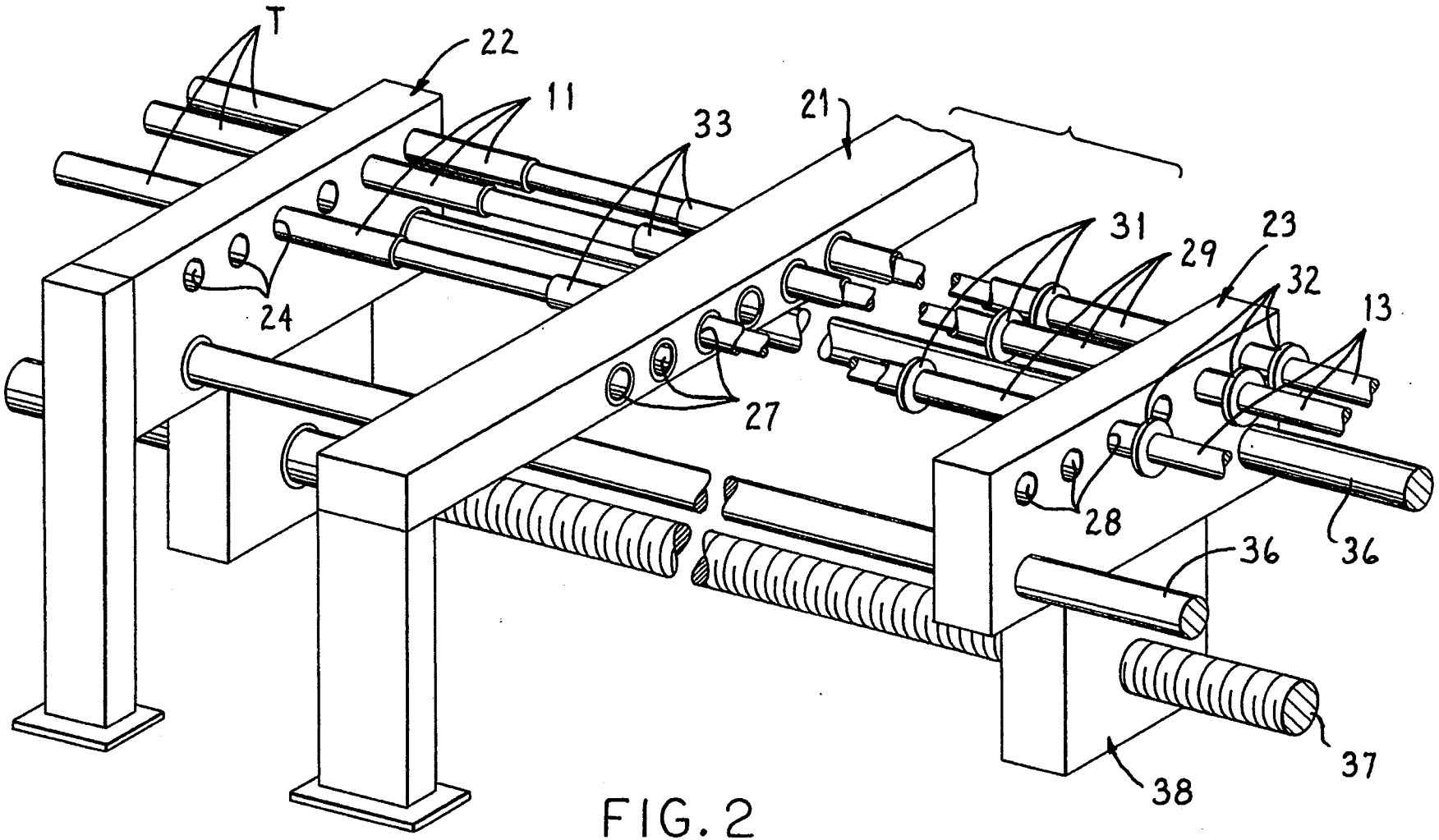
FIG. 2 is an enlarged isometric view of a fragment of the tube bender.
Figure 4:
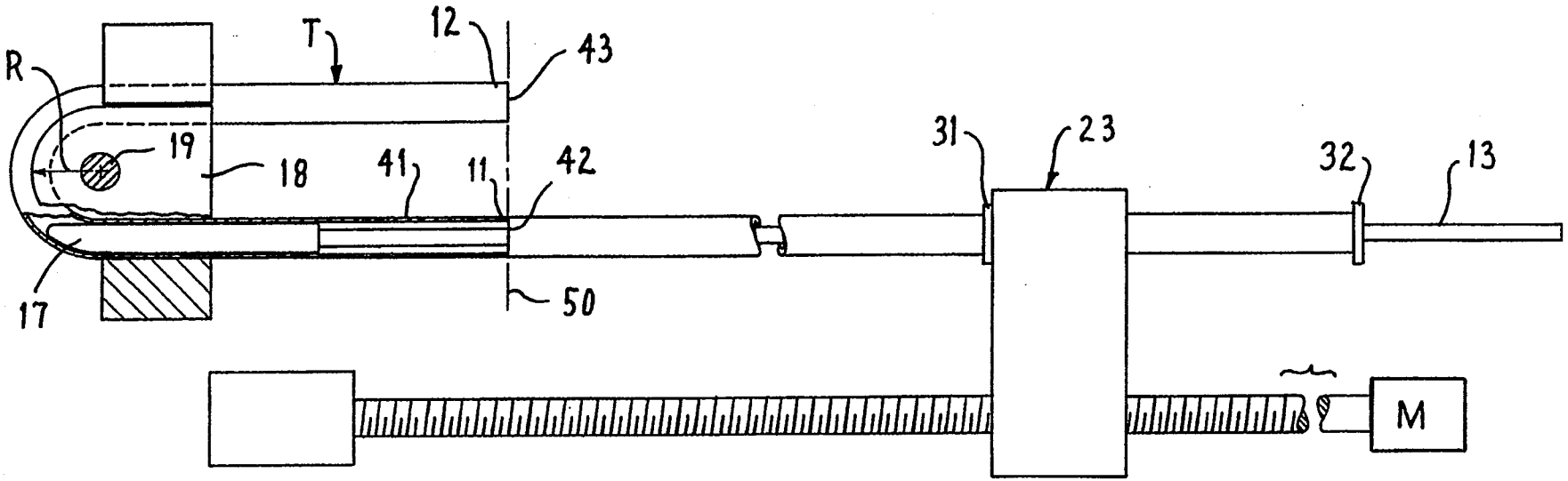
FIG. 4 is a side view similar to FIG. 3 but with the U-shaped tube already having been formed.
Figure 5:
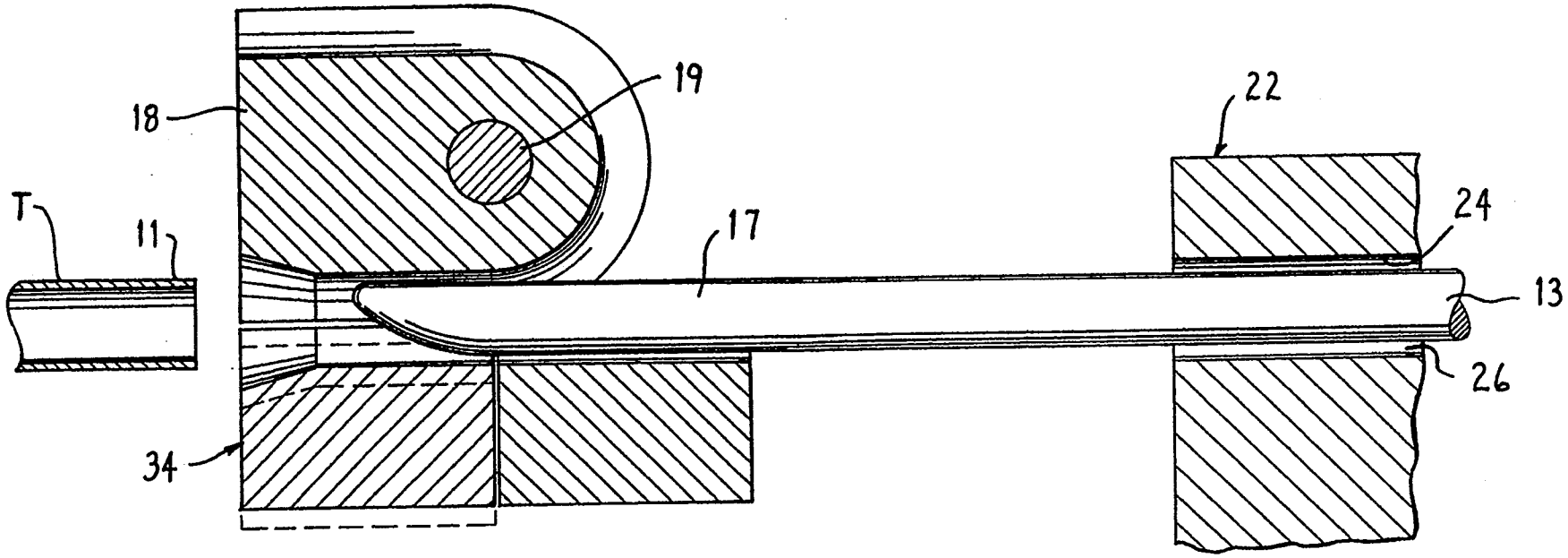
FIG. 5 is a slightly enlarged sectional view through the bend arbor and tube guide structure and prior to the entrance of a first end of a finite length segment of tube into the tube bender.

The tube bending structure illustrate in FIG. 1 is similar to the structure illustrated in U.S. Pat. No. 5,233,853 and reference thereto is to be incorporated herein by reference. The supply and delivery mechanism S is also know from the aforementioned U.S. Pat. No. 5,233,853. The control used in association with the supply and delivery means causes a plurality of finite length segments of tubing to be precut to a precise length and delivered to the tube bending device 10 so that a leading or first end 11 (FIGS. 2 and, 3) of each of the tubes T is oriented at a precise location "A" from a plane oriented perpendicular to a longitudinal axis of the tube T and containing a bend axis defined by a shaft 19. Since the opposite second end 12 of the tubes T are cut so that the tube segment length is of a precise dimension, the location of the second end thus becomes known prior to a bending of the tube into a U-shape. As is shown in FIG. 2, a plurality of tube mandrels 13 are supported on a bracket 14 (FIG. 1) secured to a frame 16 of the tube bending device 10. In FIG. 2, the tube mandrels 13 are shown to extend through only three out of the six locations therefor. This abbreviated showing is for illustrative purposes only and to eliminate redundant structure that would otherwise block a meaningful showing of the overall structure. The end of the tube mandrels 13 remote from the bracket 14 each have a bend mandrel 17 (FIGS. 4 and 5) oriented closely adjacent the bend arbor 18, which bend arbor is pivotally supported on the shaft 19. The tube mandrels 13 pass through holes provided in a guide bar 21, a further guide bar 22 and a carriage 23. If desired, the guides 21 and 22 can be supported for movement left and right on the frame 16 illustrated in FIG. 1. In this particular embodiment, however, the guides 21 and 22 are stationary. As is illustrated in FIGS. 2 and 5, the guide bar 22 has a plurality of side by side holes 24 extending therethrough, the internal diameter of which is greater than the outer diameter of the tube mandrels 13 so that an annular gap 26 is provided to receive the first end 11 of each tube T. On the other hand, the holes 27 extending through the guide bar 21 as well as the holes 28 extending through the carriage 23 are, in addition to being axially aligned with the holes 24 in the guide bar 22, larger in diameter to accommodate a sleeve 29 telescopically mounted over each of the tube mandrels 13. In this particular embodiment, each sleeve 29 has a pair of axially spaced, radially outwardly extending flanges 31 and 32 thereon and oriented on opposite sides of the carriage 23. The radially outward extent of each of the flanges 31 and 32 is greater than the diameter of the holes 28 extending through the carriage 23. An end of each sleeve 29 remote from the flange 32, which end is identified at 33, is positioned to engage the leading end or first end 11 of each of the tubes T after the tubes T have become fixedly oriented in the tube bender and a clamping mechanism 34 (FIG. 5) has been activated to move the clamping mechanism from the broken line position to the solid line position to effectively hold the tubes T in a fixed relation with the bend ardor 18. The clamp mechanism 34 is of a conventional design and is embodied in the structure illustrated in U.S. Pat. No. 5,233,853.

The frame 16 of the tube bender 10 includes a pair of parallel guide shafts 36 on which is slidably supported the aforesaid carriage 23. The frame 16 also includes an elongated externally threaded shaft 37 extending lengthwise of the tube bender 10 and is driven for rotation by a motor M. The carriage 23 includes an internally threaded nut portion 38 which is threadedly engaged with the threads on the threaded rod 37 so that as the motor M drives the threaded rod 37 for rotation, the carriage 23 will be driven lengthwise of the guide rods 36 toward and away from the guides 21 and 22. As stated above, if for some reason the carriage 23 needs to move beyond the position of the guide 21, the guide 21 can, if desired, be supported for movement on the guide rods 36 and moved leftwardly toward the guide bar 22 as the carriage 23 is moved through its path of movement. Upon a return stroke of the carriage 23 to the right in FIG. 2, further structure can be provided for drawing the guide bar 21 back to its guide position illustrated in FIG. 2 while the carriage 23 continues to its initial position also illustrated in FIG. 2.

Figure 3:
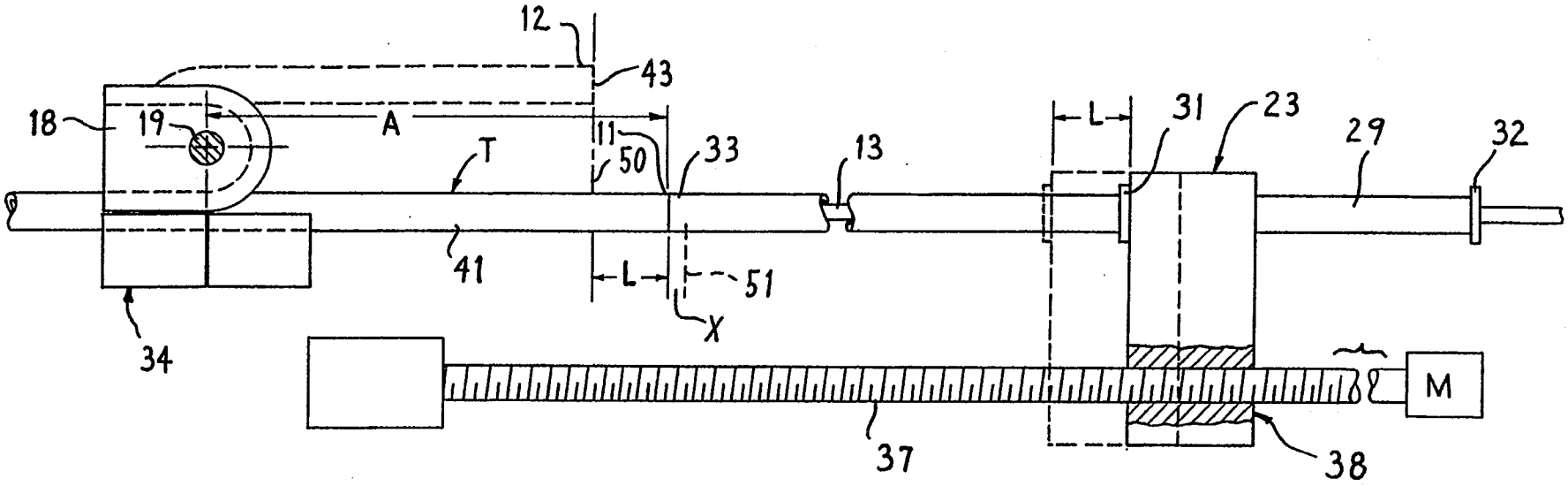
FIG. 3 is a side elevational view of a fragment of tubing that is to be bent into a U-shape and a fragment of the tube length control structure.

The purpose for the aforementioned structure is to cause the ends 33 of the sleeves 29 to be brought into engagement with the first ends 11 of the tubes T as illustrated in FIG. 3. The carriage 23 will first move into engagement with the flange 31 on each of the sleeves 29 to thence bring the aforesaid ends 33 into the mentioned engagement with the ends 11. Thereafter, and with the clamping mechanism 34 effectively clamping the tube segment to the bend arbor 18, the bend arbor 18 is then pivoted about the shaft 19 from the FIG. 3 position to the FIG. 4 position to bring the aforementioned second end 12 of the tube T to a location adjacent the first end 11 as illustrated in FIG. 4. As the bend movement occurs, the carriage 23 will simultaneously move through a predetermined distance L to cause the end 33 on each of the sleeves 29 to push on the first ends 11 of each of the tubes to cause the material of the leg 41 to be moved lengthwise to the left as the bend is occurring to fixedly orient an end face 42 of the leg 41 at a carefully controlled location 50. Since the position of the second end 12 of the tube T was known prior to the bend, its location at the completion of the bend illustrated in FIG. 4 is also such that the end face 43 is coplanar with the end face 42 at the controlled location 50.

A movement of the bend arbor 18 between its FIG. 3 and its FIG. 4 position is caused by a conventional drive mechanism 44 (FIG. 1). The number of degrees through which the tube has been bent is measured by a detector 46 and a corresponding signal therefrom is fed through a control line 47 to a control device 48. The control device 48 in turn produces a signal fed through a control line 49 to the motor M so that the threaded rod 37 will be rotated through a prescribed number of revolutions for each degree of rotation of the bend arbor 18 about the shaft 19 driven by the drive device 44. As a result, the carriage 23 will be moved in a slaved relation to the movement of the bend arbor about the axis of the shaft 19 toward the left to bring the ends 33 of the sleeves 29 into engagement with the leading end face 42 of the first ends 11 of the tubes T. Thereafter, and for each degree of movement of the bend arbor 18 about the shaft 19, the control device 48 will control the operation of the motor M so that the carriage 23 will be moved a prescribed distance L to forcibly place the end face 42 of the first end 11 of each of the tubes at the prescribed location 50 illustrated in FIG. 4. The location 50 will coincide with the location of the end face 43 of the second end 12 of each of the tubes following a bend of the tubes to a U-shape as illustrated in FIG. 4. Thereafter, the motor M will continue rotating in the same direction to cause the sleeves to effect an ejection of the bent tubes from the bender, followed by a drive in the reverse direction of rotation to cause the sleeves 29 to be retracted away from the end faces 42 so that another cycle of operation can be completed.

As is illustrated in FIG. 4, the radius of the bend is designated as R. The length of the longitudinal axis of the tube extending through the 180° bend is equal to $\pi R$. For each degree of movement of the bend arbor 18, the bend sensor 46 will send a signal through the control line 47 that is generally equal to $\pi R$ divided by the number of degrees through which the tube is to be bent. In this particular instance, the tube T is bent through a 180° angle and, therefore, the bend sensor 46 will send a signal to the control device 48 that is generally equal to $\pi R$ divided by 180° for each degree of movement of the bend arbor 18. As a result, the increment of length through which the carriage 23 is moved to urge the sleeves 29 leftwardly following an initial engagement of the ends 33 thereof with the end faces 42, will be equal to $\pi R$ divided by 180° times the number of degrees through which the bend arbor is moved which, in this case, is 180° and, therefore, the predetermined length L is equal to $\pi R$.

In some instances, the tubes T before they are bent into their hairpin shape may be telescoped onto the tube mandrels to a new position wherein the first ends 11 are oriented at a predefined location 51 illustrated in FIG. 3. Since the movement of the carriage 23 is still programmed so that the ends 33 of the sleeves 29 will arrive at the predetermined location 50 following a 180° bend in the tube T, it will be understood that the tubes T before they are bent into a 180° bend are slightly longer in this embodiment by the spacing X between the location 51 and the right end of the dimension L illustrated in FIG. 3. Further, the end face 43 of the second end 12 of the tubes T will be brought to the aforementioned predetermined location 50. The spacing X is optimally 0.010 to 0.020 inches. The carriage 23 will still urge the first ends 11 of the tubes T to the predefined location 50. The extra distance X (that is, $\pi R+X$) that the carriage 23 pushes on the first ends 11 will assure that the end faces 42 of the first ends 11 will be generally coplanar with the end faces 43 at the second ends of the tubes T. As a result, the amount of lubricant that may be present at the bend mandrels 17 can vary and not effect the end positioning of the end faces 42 and 43 as illustrated in FIG. 4 simply because the sleeves 29 will urge the first ends 11 of the tubes T to a precisely controlled final destination 50. With the end faces 42 and 43 now being closely coplanar to one another, further processing of the hairpin tubes can occur with little or no difficulty.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tube length control for a tube bending mechanism, comprising:

a tube bending device;

supply and delivery means for intermittently supplying at least one finite length segment of tubing and delivering said finite length segment to said tube bending device, said tube bending device having a bend arbor pivotal about a bend axis and an elongated tube mandrel extending longitudinally away from said bend arbor on a side of said bend axis remote from said supply and delivery means, said supply and delivery means simultaneously causing a first end of said finite length segment to become telescoped over said tube mandrel as said finite length segment is delivered to said tube bending device;

clamping means on said bend arbor and initially oriented on a side of said bend axis adjacent said supply means for clamping said finite length segment to said bend arbor and thereby fixedly orienting a second end of said finite length segment from said bend axis;

first drive means for drivingly pivoting said bend arbor through a predetermined angle to effect a bending of said finite length segment;

first control means for limiting the delivery of said finite length segment to said tube bending device so that the first end thereof is oriented a predetermined distance on a side of a plane, oriented perpendicular to a longitudinal axis of said finite length segment and containing said bend axis, that is remote from said supply and delivery means;

second drive means for drivingly engaging said first end of said finite length segment and for pushing said first end along said tube mandrel toward said clamping means;

second control means for halting the movement of said second drive means toward said bend axis at a location whereat said first end, following 180° bend, becomes generally coplanar with said second end.

2. The tube length control according to claim 1, wherein said second control means includes a third control means for controlling a rate of movement and a distance through which said first end is moved along said tube mandrel to a ratio of the distance to be moved divided by the number of degrees in said predetermined angle, said predetermined distance equalling said ratio multiplied by the number of degrees in said predefined angle.

3. The tube length control according to claim 2, wherein said third control means includes means for effecting a slaved relation between said first drive means and said second drive means causing said second drive means to move said first end, for each degree of bend caused by said first drive means, at said ratio.

4. The tube length control according to claim 2, wherein a plurality of finite length segments are simultaneously supplied and delivered by said supply and delivery means to said tube bending device, and wherein said tube bending device includes additional means for accommodating said plurality of finite length segments and effecting a simultaneous bend controlled by said first and second control means and in the same manner as with the first mentioned finite length segment.

5. The tube length control according to claim 2, wherein said distance to be moved is $\pi R$, where R is a radius through which the longitudinal axis of said finite length segment is bent following a movement of said bend arbor through said predefined angle.

6. The tube length control according to claim 2, wherein said distance to be moved is $\pi R+X$, where R is a radius through which the longitudinal axis of said finite length segment is bent following a movement of said bend arbor through said predefined angle and X is in the range of 0.010 to 0.020 inches.

7. The tube length control according to claim 1, wherein said first and second ends are oriented in planes perpendicular to the longitudinal axis of said finite length segment.

8. The tube length control according to claim 1, wherein said first and second ends, following a 180° bend, are within 0.005 of being perfectly coplanar.

9. A method for controlling the orienting of the ends of a finite length segment of tube following a bend thereof through a predefined angle, comprising the steps of:

supplying and delivering at least one straight finite length segment of tube having first and second ends to a tube bender for bending said tube about a bend axis;

orienting said first end of said finite length segment a predetermined distance on a side of a plane oriented perpendicular to a longitudinal axis of said finite length segment and containing a bend axis about which said finite length segment is to be bent, said side being remote from said supply and delivery means;

clamping said finite length segment to said bend arbor for movement therewith;

moving the bend arbor through said predefined angle to effect a bending of the finite length segment while simultaneously pushing the first end of said finite length segment toward a location whereat said finite length segment is clamped to said bend arbor; and halting the pushing of the first end following the predefined angle of bend, at a location whereat the first end becomes generally coplanar with the second end.

10. The method according to claim 9, wherein said halting step also includes a controlling of a rate of movement and distance through which said first end is moved to a ratio of the distance to be moved divided by the number of degrees in said predefined angle, said predetermined distance equalling said ratio multiplied by the number of degrees in said predefined angle.

11. The method according to claim 10, wherein said distance to be moved is $\pi R$, where R is a radius through which the longitudinal axis of said finite length segment is bent following a movement of said bend arbor through said predefined angle.

12. The method according to claim 10, wherein said distance to be moved is $\pi R+X$, where R is a radius through which the longitudinal axis of said finite length segment is bent following a movement of said bend arbor through said predefined angle and X is in the range of 0.010 to 0.020 inches.

13. The method according to claim 9, wherein said predefined angle is 180°.

* * * * *